US008801313B2

(12) United States Patent
Tomohiro

(10) Patent No.: US 8,801,313 B2
(45) Date of Patent: Aug. 12, 2014

(54) PEN WITH PRESSURIZING MECHANISM TO PRESSURIZE INK REFILL

(75) Inventor: Hosoya Tomohiro, Sukagawa (JP)

(73) Assignee: Micro Co., Ltd. (JP)

( * ) Notice: Subject to any disclaimer, the term of this patent is extended or adjusted under 35 U.S.C. 154(b) by 270 days.

(21) Appl. No.: 13/465,729

(22) Filed: May 7, 2012

(65) Prior Publication Data

US 2013/0058703 A1 Mar. 7, 2013

(30) Foreign Application Priority Data

Sep. 6, 2011 (JP) ..... 2011-193633

(51) Int. Cl.
*B43K 5/18* (2006.01)

(52) U.S. Cl.
USPC ..... 401/188 A; 401/188 R; 401/101; 401/111; 401/112

(58) Field of Classification Search
USPC ..... 401/188 A, 188 R, 101, 109–112, 99, 401/104, 105
See application file for complete search history.

(56) References Cited

U.S. PATENT DOCUMENTS 3,075,497 A * 1/1963 Tate ..... 401/187
3,415,603 A * 12/1968 Blanchard ..... 401/101
7,128,491 B2 * 10/2006 Kobayashi ..... 401/188 A
7,604,427 B2 * 10/2009 Taniguchi ..... 401/188 A
7,819,601 B2 * 10/2010 Taniguchi ..... 401/188 A
8,511,925 B2 * 8/2013 Noguchi ..... 401/188 A

FOREIGN PATENT DOCUMENTS

JP 2005138356 6/2005
JP 2005246648 9/2005

* cited by examiner

*Primary Examiner* — David Walczak
(74) *Attorney, Agent, or Firm* — Adams & Wilks

(57) ABSTRACT

A pressurizing-type pen has a compression cylinder fitted to a rear portion of a refill holder which holds an ink-containing refill. A return spring holder holding an elastic airtight member is inserted inside the refill holder. When the compression cylinder advances, the refill holder also advances and presses the airtight member to bring the inner face of the airtight member into close contact with the refill to close a vent path. When the compression cylinder further advances, the rear space of the refill is pressurized by a compression chamber provided within the compression cylinder. Then, following the advance movement of the compression cylinder, the airtight member and the return spring holder advance together with the refill holder and the refill, and the refill is thereby maintained at the writing position. The elastic member does not make sliding contact with the refill and therefore is not abraded.

17 Claims, 16 Drawing Sheets

PEN WITH PRESSURIZING MECHANISM TO PRESSURIZE INK REFILL

BACKGROUND OF THE INVENTION

1. Technical Field

The present invention relates to a pressurizing-type pen in which the ink contained in an ink refill is pressurized by the user at the time of writing to assist in writing.

2. Related Art

Pressurizing-type pens such as ball point pens have been known in which, when the front end of a refill accommodated in a pen barrel is protruded to a writing position by a knocking operation, the ink supplied to the writing tip at the front end of the refill can be pressurized by applying air pressure to a rear space of the refill filled with the ink. For example, JP-A-2005-246648 and JP-A-2005-138356 describe such pressurizing-type pens.

In pressurizing-type pens, generally, when the front end of a refill is fed from a barrel by a knocking operation, the periphery of a rear portion of the refill is closed to form a closed space and air in the closed space is compressed to pressurize the rear space of the refill. In many cases, as a sealing member for forming the closed space, an elastic member which is in sliding contact with the periphery of the refill is used. For example, the pressurizing-type pen described in JP-A-2005-246648 uses an O-ring having such an inner diameter that makes it possible to slidably move in sealing contact with the periphery of an outer face of an ink reservoir. In the ball point pen described in JP-A-2005-138356, an annular elastic member formed by an O-ring is constituted such that the elastic member sealingly and slidingly contacts with and detachs from the inner face of a cylinder.

Accordingly, in conventional pressurizing-type pens, when the refill moves in an axial direction, the sealing member is rubbed against the outer periphery face of the refill or against the inner face of the cylinder, and therefore the sealing member is apt to abrade. Further, since the O-ring itself is required to expand or shrink, the O-ring is likely damaged and it sometimes becomes impossible to retain an adequate sealing condition. In addition, since the air compressed by the pressurizing mechanism does not always properly act on the ink, the pressurization of the ink sometimes becomes uncertain. Further, in some cases, the pressurizing mechanism is retracted in such a condition that sealing is maintained without sufficient pressure reduction, and the ink is sucked out of the refill by suction.

Further, in conventional pressurizing-type pens, many pens employ a so-called rotating cam-type feeding mechanism as a mechanism for feeding a refill by a knocking operation, but such pens have the above pressurizing mechanism incorporated therein, and therefore the entire mechanism becomes complicated making it difficult to feed the refill securely.

SUMMARY OF THE INVENTION

It is an object of the present invention to provide a pressurizing-type pen having a pressurizing mechanism, in which a rear space of an ink refill can be pressurized when the refill is advanced and in which a sealing body in sealing contact with the outer face of the refill does not slidably move along the outer face of the refill.

It is another object of the present invention to provide a pressurizing-type pen in which the ink in the refill can be securely pressurized with no risk of backward suction of the ink by the pressurizing mechanism.

The above and other objects of the present invention are carried out by a pressurizing type pen comprising a refill movably accommodated in a barrel to undergo movement in an axial direction between a writing position and a retracted position, and a pressurizing mechanism to pressurize air in a rear space of the refill when the refill is moved to the writing position. The pressurizing mechanism comprises a refill holder which holds a rear portion of the refill in an aeration-allowed condition and which has an opening at its rear end. An elastic airtight member surrounds a periphery of the refill while providing an air vent path between the airtight member and the refill. A return spring holder holds the airtight member and is connected to a front portion of the refill holder to undergo slight movement in an axial direction within a predetermined range, and the return spring holder is urged by a return spring backwardly to a position abutting on a stopper disposed in the barrel.

A compression cylinder is fitted to a rear portion of the refill holder and has a compression chamber at its inside. A knocking-type feeding mechanism is disposed in the barrel to move the compression cylinder back and forth. An inner face of the refill holder faces the airtight member so that when the refill holder advances, the inner face of the refill holder presses and elastically deforms the airtight member to bring an inner face of the airtight member into close contact with an outer periphery face of the refill thereby closing the vent path.

The compression cylinder and the refill holder are connected by a releasable connecting means for connecting the compression cylinder and the refill holder so that when the compression cylinder advances, the compression cylinder and the refill holder advance together to a position where the refill holder presses and deforms the airtight member to close the vent path, and then the connection of the compression cylinder and the refill holder is released so that the compression cylinder can move closer to the refill holder. The refill holder with the refill and the return spring holder with the airtight member are moved forward by the compression cylinder against the return spring.

In the present invention, the front part or front portion means a front end side of the barrel at which the refill advances and from which its front end protrudes, and the rear part or rear portion means a rear end side of the barrel in which the refill retracts.

According to one aspect of the present invention, the releasable connecting means comprises locking projections formed on a front end face of the compression cylinder and outward projections disposed on an outer periphery face of the compression cylinder, inward projections formed in the barrel and on which the outward projections abut when the compression cylinder is located at the retracted position, and an engagement groove formed on an outer periphery face of the refill holder and with which the locking projections of the compression cylinder engages. The front end of the compression cylinder is elastically deformable in the radial direction of the compression cylinder so that when the outward projections engage with the inward projections of the barrel, the front end of the compression cylinder is radially contracted and the locking projection of the compression cylinder engage with the engagement groove of the refill holder. When the outward projections are detached from the inward projections of the barrel, the front end radially expands and the engagement between the locking projections of the compression cylinder and the engagement groove of the refill holder is released.

According to another aspect of the present invention, the inner face of the elastic airtight member is spaced from the outer periphery face of the refill at the non-writing time to form a vent path which communicates to the compression chamber of the compression cylinder through a gap between the outer periphery face of the refill and the inner periphery face of the refill holder via the opening at the rear end of the refill holder. When the compression cylinder is located at the retracted position and is made to advance by a knocking-type feeding mechanism, the compression cylinder and the refill holder advance together in a state in which the refill holder and the compression cylinder are releasably connected by a connecting means. As the refill holder advances, the inner face thereof abuts on the airtight member and elastically deforms the inner face of the airtight member into tight contact with the outer periphery face of the refill to close the vent path communicating from the outer periphery face of refill to the compression chamber. When the compression cylinder further advances, the connection between the refill holder and the compression cylinder by the connecting means is released and only the compression chamber advances. As a result, the air in the compression chamber of the compression cylinder is compressed and enters the inside of the refill through the opening at the rear end and pressurizes the ink.

Since the refill holder and the compression cylinder are connected until they reach the position where the vent path around the refill is closed by the airtight member, the rear space of the refill is not unfavorably pressurized before the vent path is closed and can securely be pressurized after the vent path is closed. Further, after the compression cylinder abuts on the refill holder, the refill holder with the refill and the return spring holder with the airtight member advance together against the return spring, and the refill can be held at the writing position. During this advancement, the airtight member is pressed by the refill holder and elastically clamped onto the refill so that the airtight member is not in slidable contact with the outer periphery face of the refill and will not be abraded as in the case of the sealing members of conventional pressurizing-type pens.

Further, when the above knocking-type feeding mechanism is knocked so that the refill is retracted to the non-writing position, the compression cylinder retracts by the action of the knocking mechanism, and following this action, the return spring holder with the airtight member and the refill holder with the refill retract by the action of the return spring. When the return spring holder abuts on a stopper in the barrel, the retraction of the return spring holder and the airtight member is stopped. Since the compression cylinder continues to further retract, the refill holder connected to the return spring holder in slightly movable fashion also retracts, and the deforming pressure exerted on the airtight member by the refill holder is released and the inner face of the airtight member detachs from the outer periphery face of the refill. As a result, the vent path between the outer periphery face of the refill and the inner periphery face of the refill holder is allowed to open to the outside air, and the compression chamber of the compression cylinder is connected to the vent path.

Since the movement of the return spring holder is within a predetermined limited range, it is constrained by the return spring holder within the limitation of movement and the retraction of the refill holder is stopped. Then, since only the compression cylinder retracts, the compression cylinder and the refill holder are connected by the connecting means at the retracted position, and the compression cylinder returns to the non-writing position. At this stage, in accordance with the present invention, since the compression cylinder is designed to further retract after the vent path is opened as mentioned above, no suction is exerted on the compression chamber of the compression cylinder and the ink in the refill will not be sucked backwardly.

BRIEF DESCRIPTION OF THE DRAWINGS

FIG. 2 shows a stationary cam, wherein FIG. 2(A) is a front view and FIG. 2(B) is a cross-sectional view.

FIG. 3 shows a rotating cam, wherein FIG. 3(A) is a front view, FIG. 3(B) is a cross-sectional view taken in an axial direction, FIG. 3(C) is a side view, and FIG. 3(D) is a vertical cross-sectional view.

FIG. 4(B) is a cross-sectional view taken along a long hole, FIG. 4(C) is a cross-sectional view taken along an inward projection, and FIG. 4(D) is a side view.

FIG. 5 shows a refill holder, wherein FIG. 5(A) is a front view, FIG. 5(B) is a plane view, FIG. 5(C) is a cross-sectional view, FIG. 5(D) is a cross-sectional view at a portion where the refill is held, and FIG. 5(E) is an explanatory view of the bottom of a small-diameter portion.

FIG. 7 shows a compression cylinder, wherein FIG. 7(A) is a front view, FIG. 7(B) is a cross-sectional view taken along a locking projection, FIG. 7(C) is a cross-sectional view taken along a long hole, and FIG. 7(D) is a side view.

DETAILED DESCRIPTION OF THE INVENTION

Figure 1:
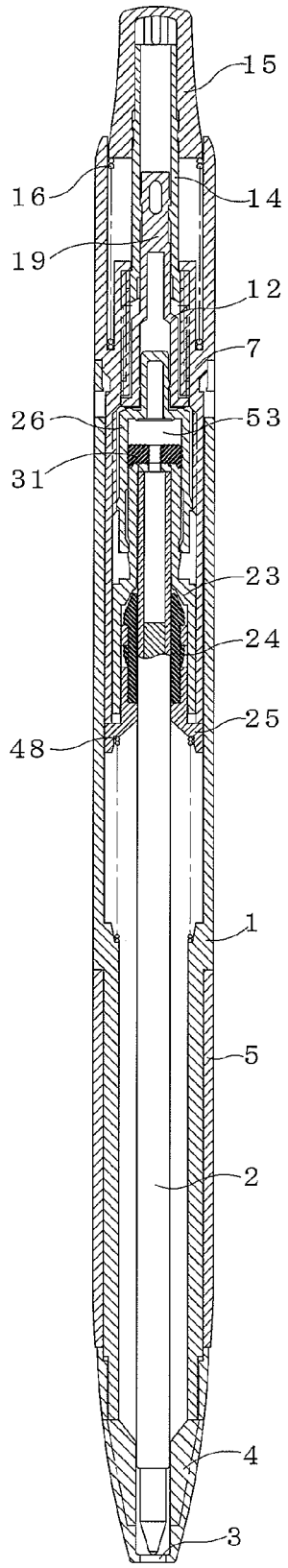
FIG. 1 is a cross-sectional view showing an example of a pressurizing-type pen according to the present invention.

FIG. 1 shows an example of a pressurizing-type pen according to the present invention. The pen comprises a barrel 1 having a tapered member 4 at its front end, which has a through-hole 3 through which a writing front end of an ink-containing refill 2 can project. The rear end of the refill 2 is provided with an opening that communicates with the space inside the rear portion of the refill. A grip 5 is disposed around the periphery of the barrel 1. A knocking-type feeding mechanism is disposed at a rear portion of the barrel and moves the refill 2 in an axial direction and holds it at a writing position (FIG. 14) and a retracted position (FIG. 1). Between the knocking-type feeding mechanism and the refill 2, is disposed a pressurizing mechanism to pressurize the rear space of the ink-containing refill when the refill is moved towards the writing position.

Figure 2:
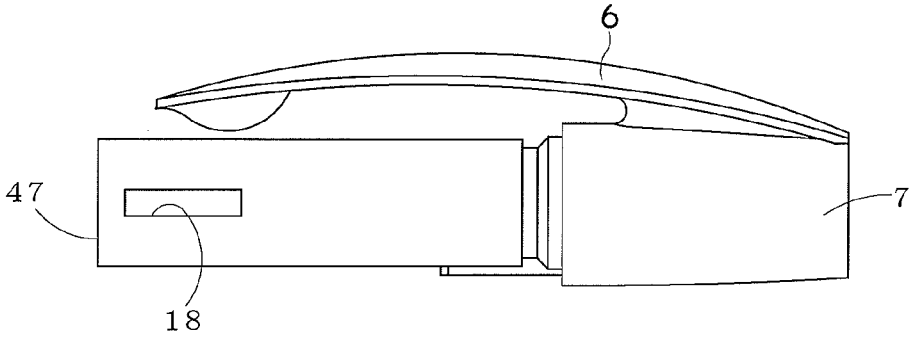
Figure 2:
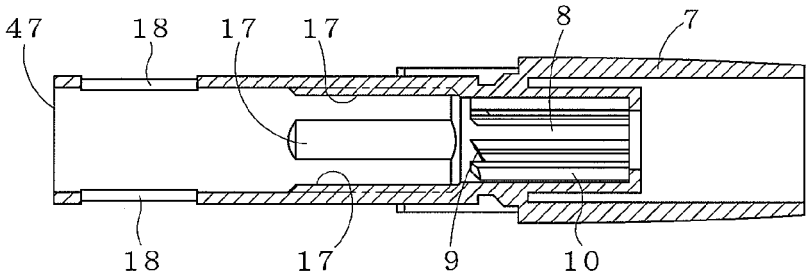
Figure 3:
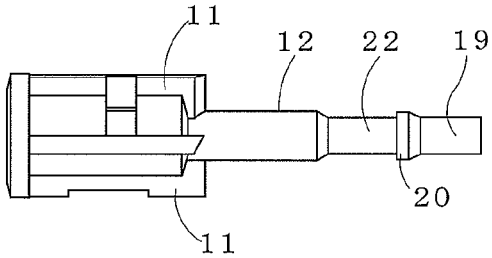
Figure 3:
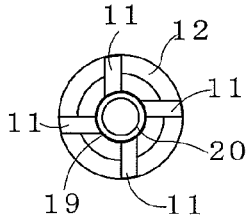
Figure 3:
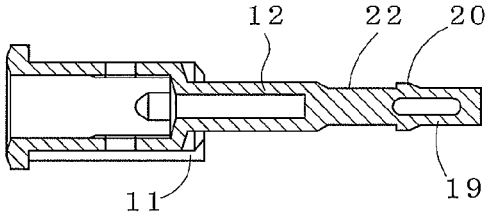
Figure 3:
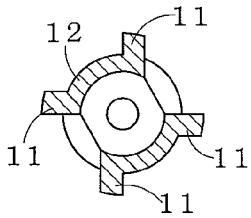
Figure 4:
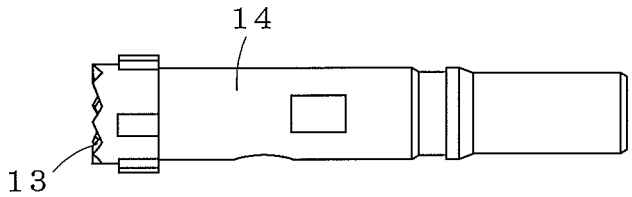
FIG. 4 shows a knocking cam, wherein FIG. 4 (A) is a front view.
Figure 4:
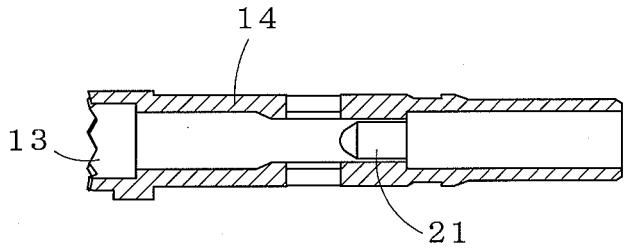
Figure 4:
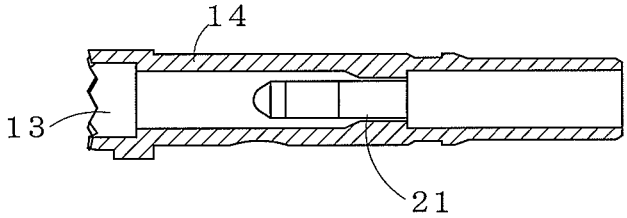
Figure 4:
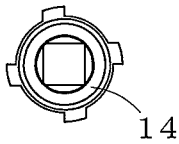

As the knocking-type feeding mechanism, various known feeding mechanisms, such as a so-called rotating cam type feeding mechanism or a heart cam type feeding mechanism, may be employed. In the example shown in FIG. 1, a well-known rotating cam type feeding mechanism is used. In brief explanation, at the rear portion of the barrel 1, a stationary cam 7 having a clip 6 is inserted and fixed, and inside the stationary cam 7 is provided a cam part 10 having alternating deep cam grooves 8 and shallow cam grooves 9 (FIG. 2). Inside the stationary cam 7, a rotating cam 12 and a knocking cam 14 are inserted. The rotating cam 12 (FIG. 3) has a ridge-like cam formed at its rear end and projecting members 11 alternately engaging with the cam grooves of the cam part 10, and the rotating cam 12 is accommodated rotatably inside the stationary cam 7. The knocking cam 14 (FIG. 4) moves straightforward in an axial direction without rotation upon the knocking operation. The knocking cam 14 has a cylindrical shape having at its front end a ridge-like cam 13 which engages with the cam of the rotating cam 12. To the rear end of the knocking cam 14, a knocking part 15 is fitted, and between the knocking part 15 and the stationary cam 7, a knock spring 16 is inserted for urging the knocking cam 14 rearward.

As well known, by the above structure, in the non-writing state, the projecting members 11 of the rotating cam 12 enter the deep cam grooves 8 of the stationary cam 7 to make the rotating cam retract. When the knocking part 15 is knocked, the rotating cam 12 advances via the knocking cam 14, and when the knocking is stopped, the knocking cam 14 retracts by the knock spring 16. The rotating cam 12 rotates and the projecting members 11 engage with the shallow cam grooves 9 of the stationary cam 7, and the refill 2 is held in the writing state where the writing front end projects from the barrel 1. In the writing state, when the knocking part 15 is knocked, the rotating cam 12 moves ahead of the stationary cam 7 via the knocking cam 14, and the projecting members 11 come out of the shallow cam grooves 9. When the knocking is stopped, the knocking cam 14 and the rotating cam 12 retract, the rotating cam 12 rotates and the projecting members 11 engage with the deep cam grooves 8 of the stationary cam 7, the refill 2 retracts, and the writing front end is accommodated in the barrel 1. The stationary cam 7 may be formed integrally inside the barrel 1 (not shown).

The above structure is not essentially different from the usual rotating cam type feeding mechanism. In the present invention, at an intermediate part of the inside of the stationary cam 7, a plurality of inward projections 17 extending in an axial direction are disposed at circumferentially spaced intervals, and at the front part of the stationary cam, a long hole 18 is formed. When the refill 2 retracts from the writing state to the non-writing state, the rotating cam 12 is connected to the knocking cam 14 so that it retracts together with the knocking cam 14. Namely, the rear part of the rotating cam 12 is formed into a small diameter part 19 that can be inserted into the inside of the knocking cam 14, and on the outer face of the small diameter part 19, an outward projection 20 is disposed. On the inner face of the knocking cam 14, an inward projection 21 is formed. The small diameter part 19 of the rotating cam 12 is inserted in the knocking cam 14 from the front side of the knocking cam, and inserted to the position where the outward projection 20 goes beyond the inward projection 21 of the knocking cam 14. Since a recess 22 is formed in front of the outward projection 20 of the rotating cam 12, the knocking cam 14 can move ahead of the outward projection 20, but when it moves rearward, it retracts together with the rotating cam 12 from the position where the inward projection 21 engages with the outward projection 20.

By the above structure, after the rotating cam 12 is advanced by the knocking operation to move the refill 2 to the writing position, when the knocking cam 14 retracts, only the knocking cam 14 retracts. However, when the rotating cam 12 is moved rearward by the knocking operation to retract the refill 2 to the non-writing position, the outward projection 20 and the inward projection 21 engage with each other and the rotating cam 12 moves rearward together with the knocking cam 14.

Figure 5:
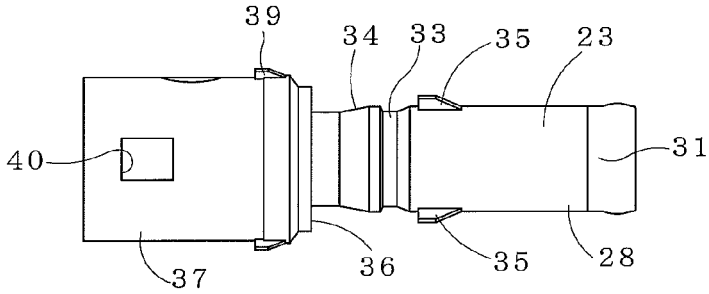
Figure 5:
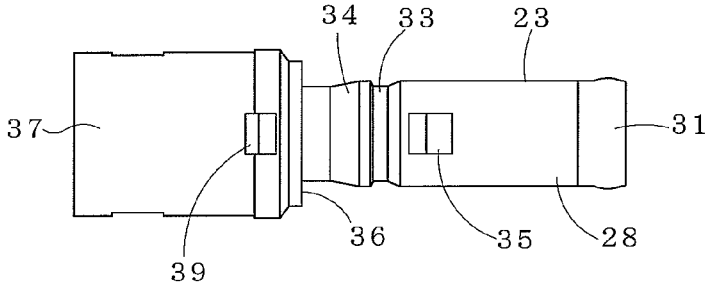
Figure 5:
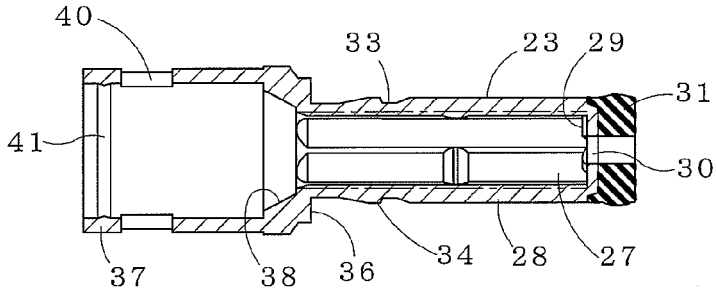
Figure 5:
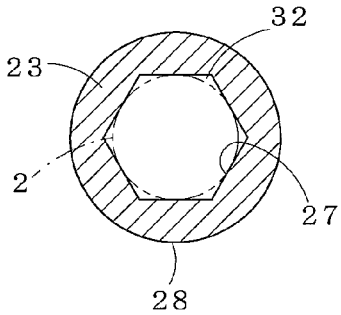
Figure 5:
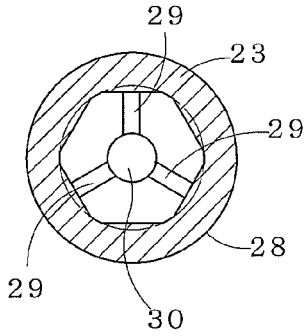

The pressurizing mechanism is mainly constituted by a refill holder 23, an elastic airtight member 24, a return spring holder 25 and a compression cylinder 26. The refill holder 23 (FIG. 5) has a small diameter part 28 having at its inner face a holding face 27 with a polygonal cross section formed to fit and hold the rear part of the refill 2 while allowing ventilation. Here, at an appropriate position of the holding face 27, a recess (not shown) may be formed into which a part of the outer periphery face of a cylindrical-shape refill fits so that the refill can be held in a stable condition. However, the depth of the recess is designed at such a level that the vent path between the outer periphery face of the refill and the inner face of the refill holder would not be closed.

At the inner end part of the small diameter part 28, projections 29 extending in a radial direction are disposed so as to allow contact with the rear end edge of the refill, but preventing close contact and allowing ventilation. The small diameter part 28 opens backward through an opening part 30, and at its rear end, an elastic member 31 made of a soft material such as elastomer is integrally disposed in a two-color (double mold) molding fashion, and the elastic member 31 is designed to slidably contact with the inner face of the compression cylinder 26. This structure provides an air vent path 32 running between the outer periphery face of the refill 2 and the inner periphery face of the refill holder 23 from the opening 30 (FIGS. 5C-5E).

Further, on the periphery of the small diameter part 28 of the refill holder 23, an engagement groove 33 is formed in an annular shape, a raised part 34 is formed at the forward portion of the engagement groove 33, and a locking click 35 is provided as a protrusion. Here, the elastic member 31 may be produced separately from the refill holder 23. In this instance, a substantially cylindrical-shape elastic member (not shown) is produced and this elastic member is installed at and connected to the rear end of the refill holder.

At the forward portion of the small diameter part 28 of the refill holder 23, a large diameter part 37 is formed via a shoulder part 36, and a slant face 38 is formed on a corner part of an inner portion of the large diameter part 37 which communicates to the small diameter part 28. On the rearward periphery of the large diameter part 37, a locking click 39 is formed and slidably engages with the long hole 18 of the stationary cam 7 to permit back and forth movement of the refill holder 23 and prevent detachment of the refill holder 23. At the circumference of the large diameter part 37, a control hole 40 is formed for connection to the return spring holder 25, and on the inner face of its forward end, a raised part 41 is disposed to hold the return spring holder 25 in a stable state.

Figure 8:
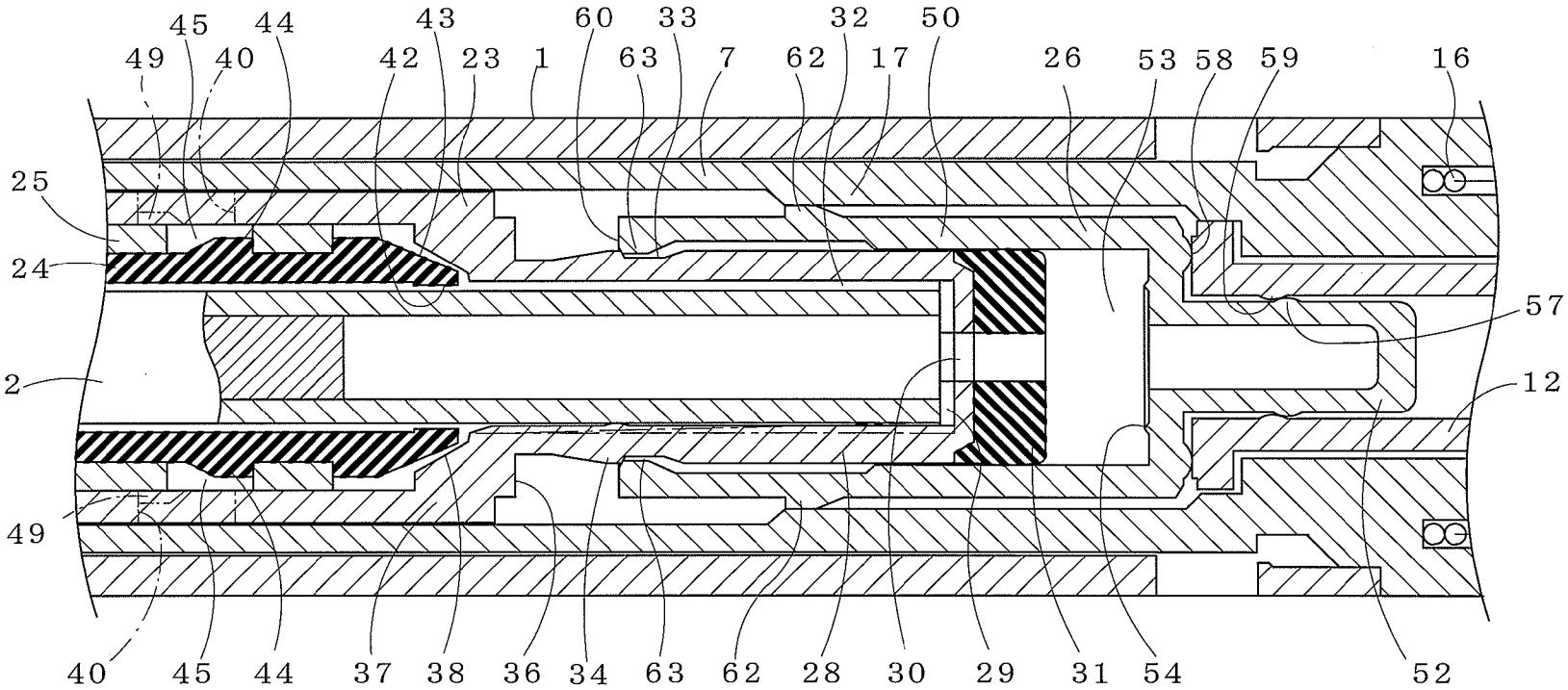
FIG. 8 is an enlarged explanatory view of the pressurizing-type pen in a non-writing state.

Into the front part of the refill holder 23, the return spring holder 25 having the airtight member 24 is inserted (FIG. 8). The airtight member 24 is made of an elastomer material or a rubber material having elasticity, and has an inner face 42 surrounding the outer periphery of the refill 2 with a space therebetween which allows contact with the refill 2 and a slant face 43 slanting to a rearward part at the end face of the airtight member. The space formed between inner face 42 of the airtight member 24 and the outer periphery of the refill 2 constitutes an air path communicating with the air vent path 32. A locking click 44 disposed on the periphery of the airtight member 24 engages with a locking hole 45 formed on the return spring holder 25, by which the airtight member is inserted into the return spring holder 25 and fixed.

Figure 6:
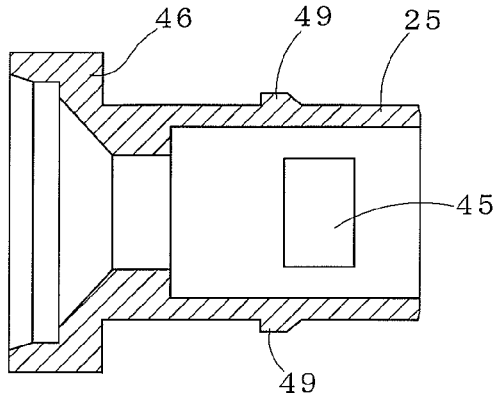
FIG. 6 is a cross-sectional view of a return spring holder.
Figure 17:
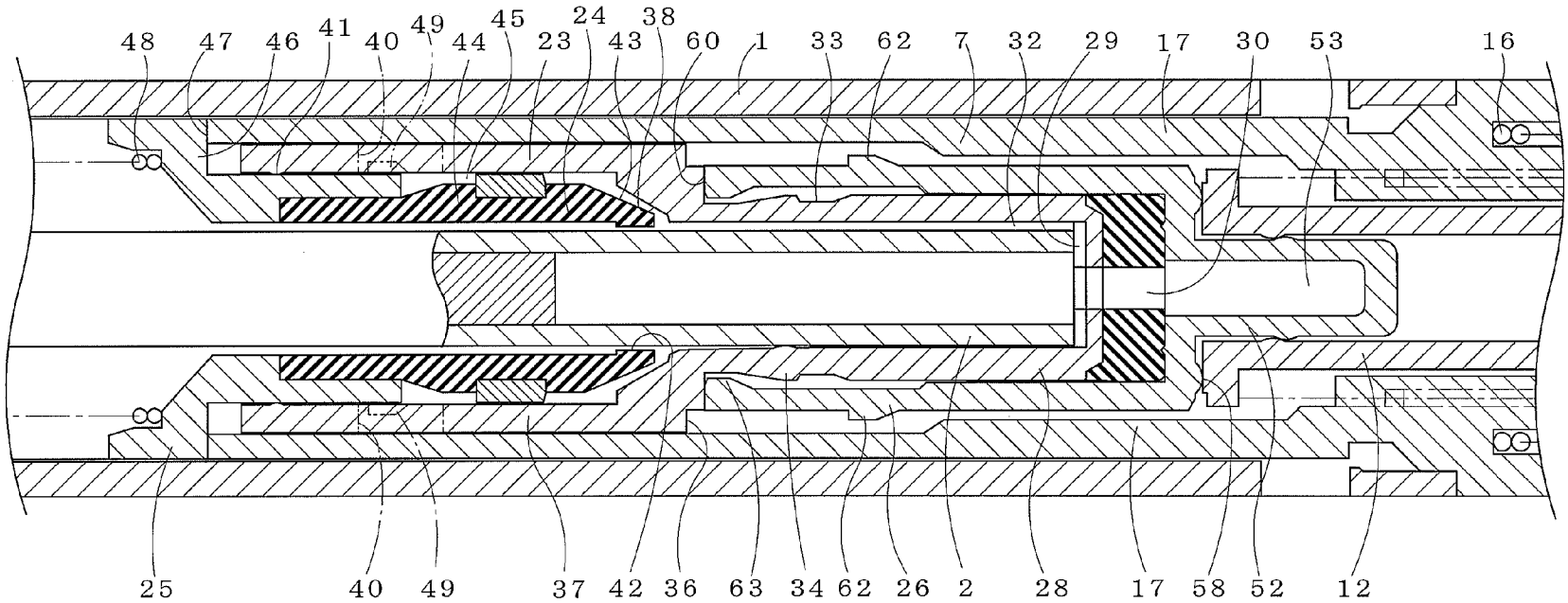
FIG. 17 is an enlarged explanatory view of the pressurizing-type pen in a state in which the movement of a return spring holder is stopped while the refill is retracting.

In the state where the return spring holder 25 is inserted into the refill holder 23, the slant face 43 of the airtight member 24 faces the slant face 38 formed on the refill holder 23. The return spring holder 25 is movable backward and forward and is urged backward by a return spring 48 to the position where a flange 46 of the return spring holder 25 abuts on a stopper 47 in the barrel as shown in FIG. 17. In the example shown in FIG. 1, the stopper 47 is a front end 47 of the stationary cam 7. The return spring holder 25 has a locking click 49 on its outer face as shown in FIG. 6 and is inserted from the front part of the refill holder 23 so that the locking click 49 can enter the control hole 40 of the refill holder 23. Under this condition, between the slant face 43 of the airtight member 24 and the slant face 38 on the inner face of the refill holder 23, a slight gap through which air passes is formed, and the air vent path 32 running on the inner face of the refill holder 23 through this slight gap communicates to the outside air. This slight gap constitutes an air path communicating the air vent path 32 to the outside air.

Figure 10:
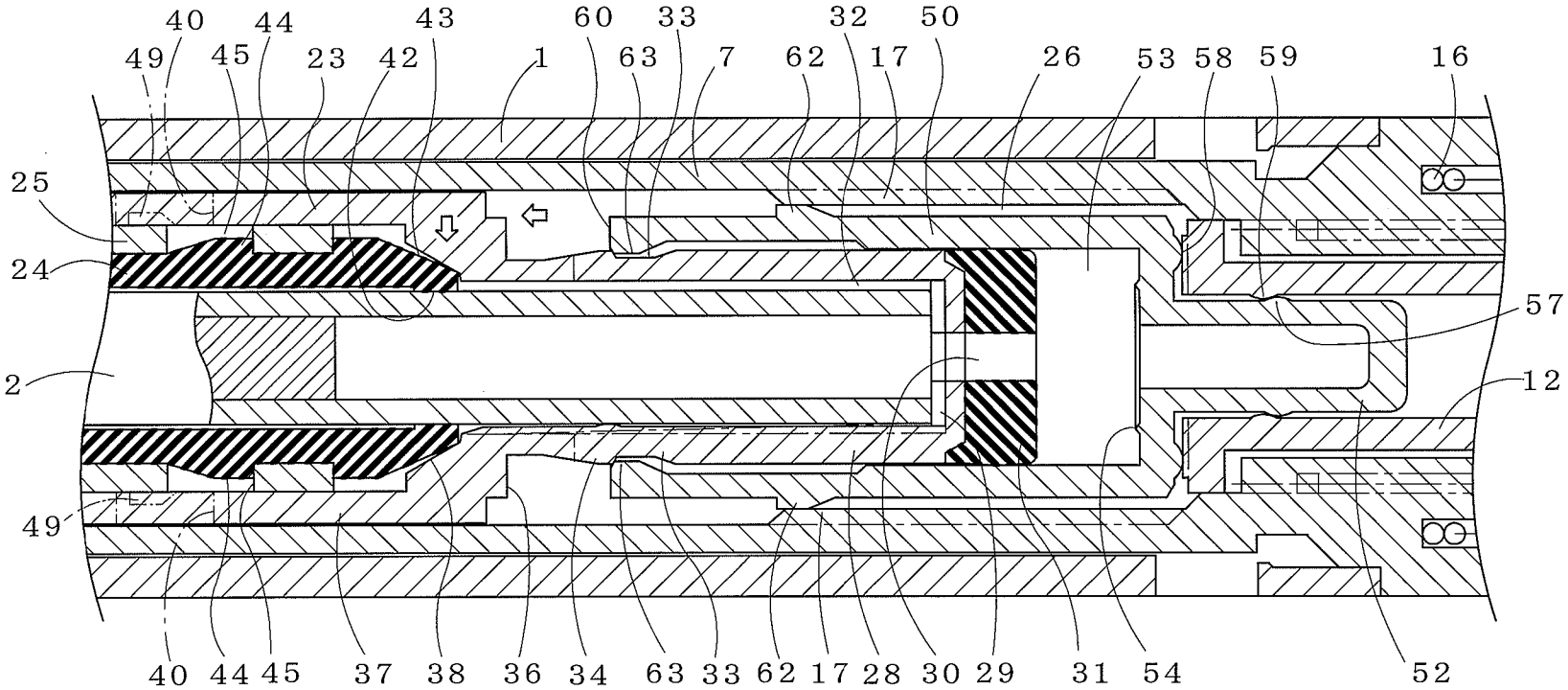
FIG. 10 is an enlarged explanatory view of the pressurizing-type pen in the non-writing state of FIG. 9.

Since the locking click 49 is loosely fitted to the control hole 40, when the return spring holder 25 abuts on the stopper 47 at the front end of the stationary cam, the refill holder 23 can slightly move in an axial direction (back and forth directions) in a predetermined range up to the position where the end edge of the control hole 40 formed on the refill holder 23 abuts on the locking click 49 (FIG. 8). When the refill holder 23 advances, the slant face 43 of the airtight member 24 is pressed and elastically deformed by the slant face 38 of the refill holder 23 to clamp the airtight member 24 to the refill 2 with the inner face 42 in close contact with the outer periphery face of the refill 2, and the air vent path is closed (FIG. 10). When the refill holder 23 retracts, the front end edge of the control hole 40 abuts on the locking click 49, thereby limiting the retraction of the refill holder 23.

Figure 7:
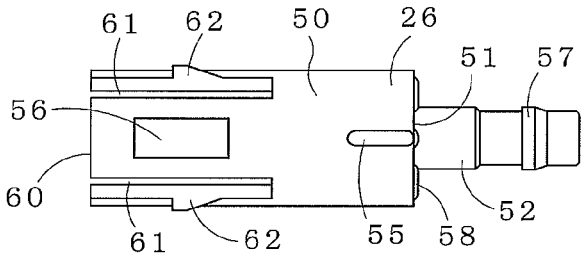
Figure 7:
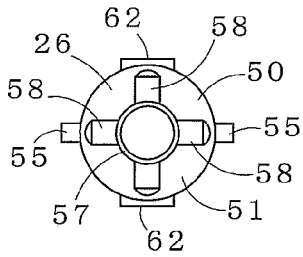
Figure 7:
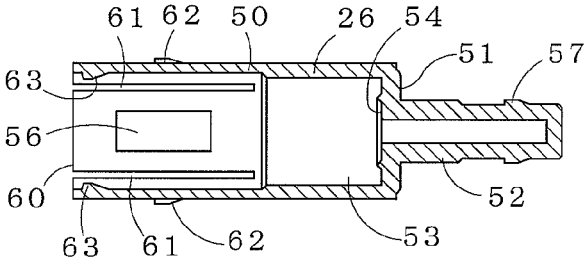
Figure 7:
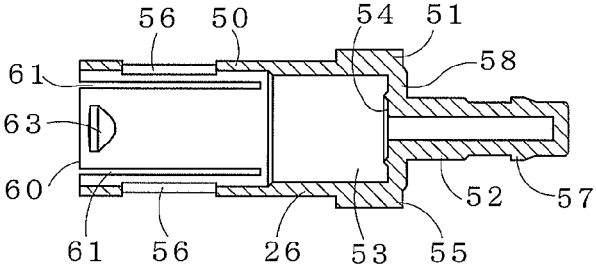

The compression cylinder 26 has, as shown in FIG. 7, a large diameter part 50 having an inner diameter to be fitted to the small diameter part 28 of the refill holder 23 and a small diameter part 52 which is continuously formed from the large diameter part 50 via a shoulder part 51 and is configured to be inserted into the rotating cam 12. As illustrated, the rear end of the small diameter part 52 is closed. The inner diameter of the large diameter part 50 of the compression cylinder 26 is designed to allow the formation of a closed compression chamber 53 when the small diameter part 28 of the refill holder 23 is inserted thereinto.

At the inner face end part of the large diameter part 50, an annular projection 54 is disposed so that the elastic member 31 disposed at the rear end of the refill holder 23 can be closely contacted with the annular projection 54 to further securely keep the airtight condition. At the outer periphery face of the rear portion of the large diameter part 50, rotation-preventing projections 55 extending in an axial direction are disposed so that the projections 55 can enter between inward projections 17 extending in an axial direction of the stationary cam 7 to prevent rotation of the compression cylinder 26. At the intermediate part of the large diameter part 50, long holes 56 are formed into which the locking clicks 35 disposed at the periphery of the refill holder 23 can enter for preventing detachment. On the periphery of the small diameter part 52, an annular locking click 57 is formed, and when it is inserted into the rotating cam 12, although the rotation of the rotating cam 12 is not transferred, the compression cylinder 26 and the rotating cam 12 are connected so that they can move axially back and forth in unison (FIG. 8).

At the shoulder part 51 of the compression cylinder 26, a plurality of rounded raised parts 58 extending in a radial direction are formed to facilitate rotation of the rotating cam 12 which abuts the rear end of the compression cylinder. In this instance, as shown in FIG. 8, it is preferred to provide an inward locking projection 59 at the inner face of the rotating cam 12 so that the annular locking projection 57 of the compression cylinder 26 can move beyond the inward locking projection 59 and conduct engagement. At the front end of the compression cylinder 26, a pressing end 60 is formed so that when the compression cylinder 26 advances, the pressing end can abut on the shoulder part 36 of the refill holder 23.

The compression cylinder 26 and the refill holder 23 are connected by a releasable connecting means which connects the compression cylinder 26 and the refill holder 23 so that when the compression cylinder 26 advances, the compression cylinder 26 and the refill holder 23 can advance together as a unit until the refill holder 23 engages with and presses on the airtight member 24, and then only the compression cylinder 26 can continue to advance in an axial direction until it engages with the shoulder part 36 of the refill holder 23 following which the compression cylinder and the refill holder can again advance together as a unit. The releasable connecting means may be constituted in various manners. In the example shown in FIG. 1, it is constituted as explained below.

With reference to FIG. 7, a slit 61 is formed in the front part of the large diameter part 50 of the compression cylinder 26 so as to make the front part elastically expandable in the radial direction. Outward projections 62 are disposed at the outer periphery of the expandable part, and locking projections 63 are formed at the inner periphery of the front end thereof. As shown in FIG. 1 and FIG. 8, when the refill 2 is located at the retracted position, the outward projections 62 are located in slidable contact with the inner side of the front end of the inward projections 17 of the stationary cam 7, whereby the front end of the compression cylinder 26 is slightly elastically contracted in the radial direction and the locking projections 63 at the front end engage with the engagement groove 33 of the refill holder 23.

By this structure, the refill holder 23 and the compression cylinder 26 are connected so that they can advance forwardly together. When the compression cylinder 26 advances to the position where the outward projections 62 no longer contact the inward projections 17 of the stationary cam 7, the front end of the compression cylinder 26 radially expands to its normal state, and the locking projections 63 detach from the engagement groove 33. The front end of the compression cylinder 26 is thereby radially expanded beyond the raised part 34 of the refill holder 23, and the connection of the refill holder 23 and the compression cylinder 26 is released. When the compression cylinder 26 further advances, the pressing end 60 abuts on the shoulder part 36 of the refill holder 23 and the refill holder can be advanced again by continued advancement of the compression cylinder.

As the releasable connecting means, other suitable mechanisms may be employed. For example, a mechanism similar to a chuck mechanism of the usual knocking-type mechanical pencil may be used. In this instance, the front end of the compression cylinder is formed elastically in outwardly expandable fashion like a collet chuck, and a clutch ring is fitted like a clutch ring of a chuck mechanism around the front end to enable radial opening and closing so that the compression cylinder can chuck the small diameter part of the refill holder. By radially closing the front end of the compression cylinder by the clutch ring, the refill holder is connected to the compression cylinder and they advance together until the refill holder engages and presses against the airtight member. By constituting this mechanism in such a manner that after the refill holder presses against the airtight member, the clutch ring abuts on a suitable stopper and its movement can thereby be stopped, the chuck is opened and the connection of the refill holder and the compression cylinder is thereby released, and the movement of the refill holder is stopped. Since the compression cylinder further advances thereafter, the pressing end of the compression cylinder can be positioned close to the shoulder part of the refill holder. When the pressing end of the compression cylinder abuts on the shoulder part of the refill holder, the refill holder can be moved again by continued movement of the compression cylinder.

The operation of the pressurizing-type pen will be explained below with reference to FIG. 1 and FIG. 8 to FIG. 19. As shown in FIG. 1, the refill 2 is located at the retracted position in the non-writing state, and the writing front end is accommodated in the barrel 1. Under such condition, the compression cylinder 26 is urged backward by the knock spring 16 via the rotating cam 12 and the knocking cam 14. Accordingly, as shown in FIG. 8, the outward projections 62 of the compression cylinder 26 enter the inside of the inward projections 17 of the stationary cam 7, the front end of the compression cylinder 26 radially contracts to its closed state, and the locking projections 63 at the front end of the compression cylinder 26 engage with the engagement groove 33 of the refill holder 23. Further, the slant face 38 formed on the inner face of the refill holder 23 does not press the slant face 43 of the airtight member 24, and the air vent path 32 running between the airtight member 24 and the outer periphery face of the refill 2 toward the compression chamber 53 of the compression cylinder 26 communicates to the outside air.

Figure 9:
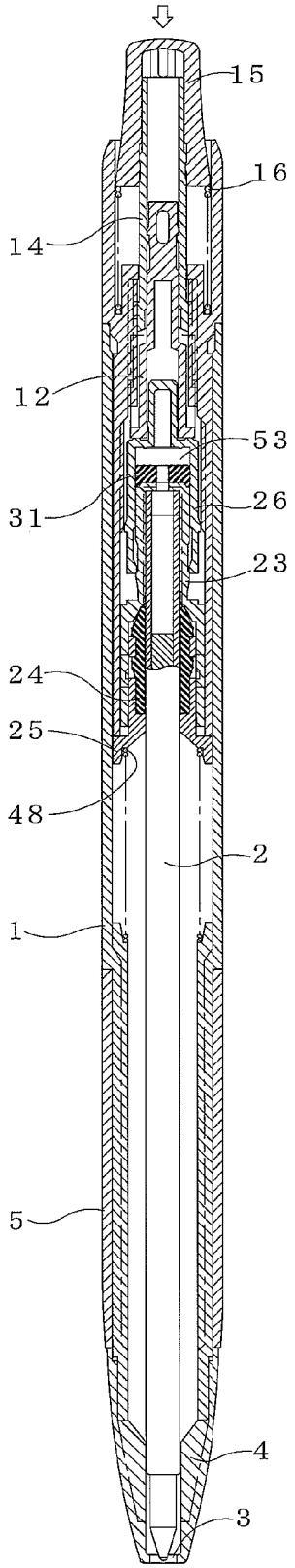
FIG. 9 is a cross-sectional view of the pressurizing-type pen showing a knocking part at the initial stage of knocking.

As shown in FIG. 9, when the knocking cam 14 is knocked, the compression cylinder 26 is advanced due to its engagement with the advancing rotating cam 12, and the refill holder 23 connected to the compression cylinder 26 also advances. As a result, as shown in FIG. 10, the slant face 38 of the refill holder 23 abuts on the slant face 43 of the airtight member 24, and the corner part of the airtight member 24 is pressed obliquely and elastically deformed to clamp onto the refill 2, whereby the inner face 42 of the airtight member 24 is positioned in close contact with the outer periphery face of the refill 2, the vent path 32 is closed, and at the rear part of the compression cylinder 26, the compression chamber 53 is placed in a sealed condition. In this instance, the airtight member 24 is urged backward by the return spring 48 via the return spring holder 25, and the locking click 49 of the return spring holder 25 is loosely fitted in the control hole 40 of the refill holder 23, whereby the airtight member 24 is kept in the stopped state and the inner face 42 is securely pressed against the outer periphery face of the refill 2.

Figure 11:
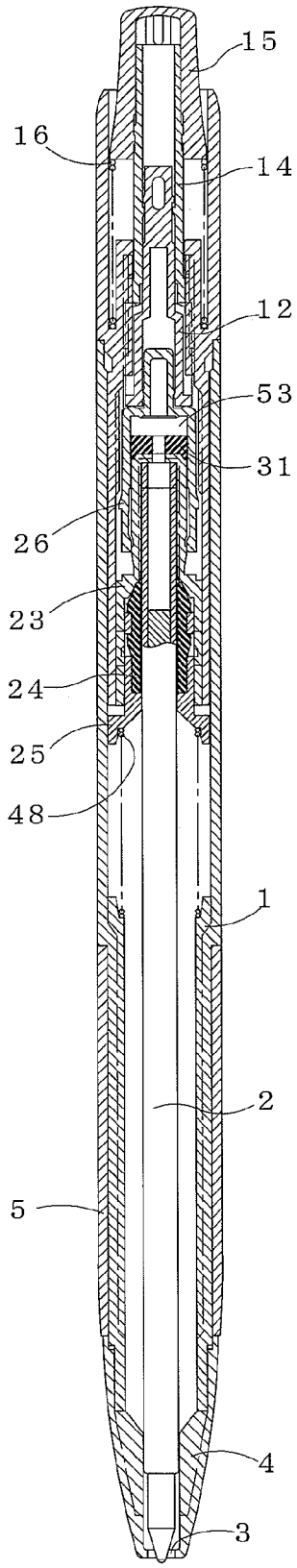
FIG. 11 is a cross-sectional view of the pressurizing-type pen in a state in which knocking is continued from the state shown in FIG. 9.
Figure 12:
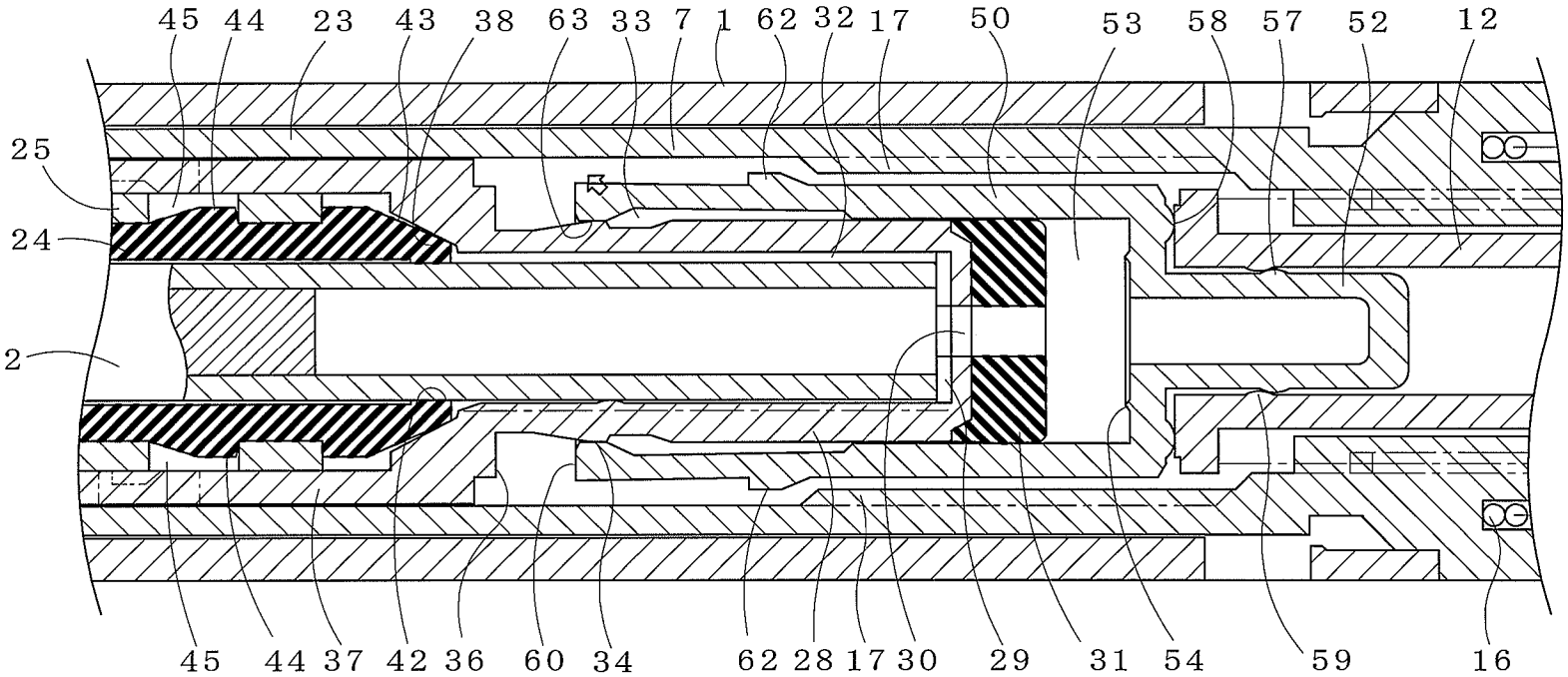
FIG. 12 is an enlarged explanatory view of the pressurizing-type pen in the state shown in FIG. 11.

When the compression cylinder 26 further advances, as shown in FIG. 11 and FIG. 12, the outward projections 62 of the compression cylinder 26 are detached from the inward projections 17 of the stationary cam 7, the closure at the front end is released, and the locking projections 63 come out of the engagement groove 33 of the refill holder 23. Since the connection between the refill holder 23 and the compression cylinder 26 is thereby released, the refill holder 23 stays at this position. Since the compression cylinder 26 continues to advance, at substantially the same time as the release from the connection, the compression cylinder 26 advances and approaches close to the shoulder part 36 of the refill holder 23 in the axial direction. By the continued advancing movement of the compression cylinder 26, the air in the compression chamber 53 is compressed and passes through the opening 30 of the refill holder 23 and enters the rear space of the refill 2, and pressurizes the ink in the refill (see FIG. 13 to FIG. 15).

Figure 13:
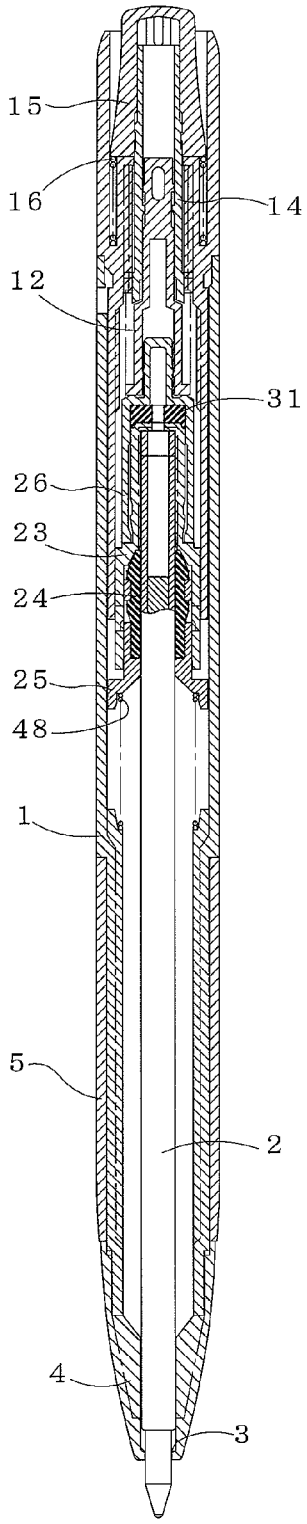
FIG. 13 is a cross-sectional view of the pressurizing-type pen in a state in which the writing front end of a refill projects from a front end of a barrel.
Figure 14:
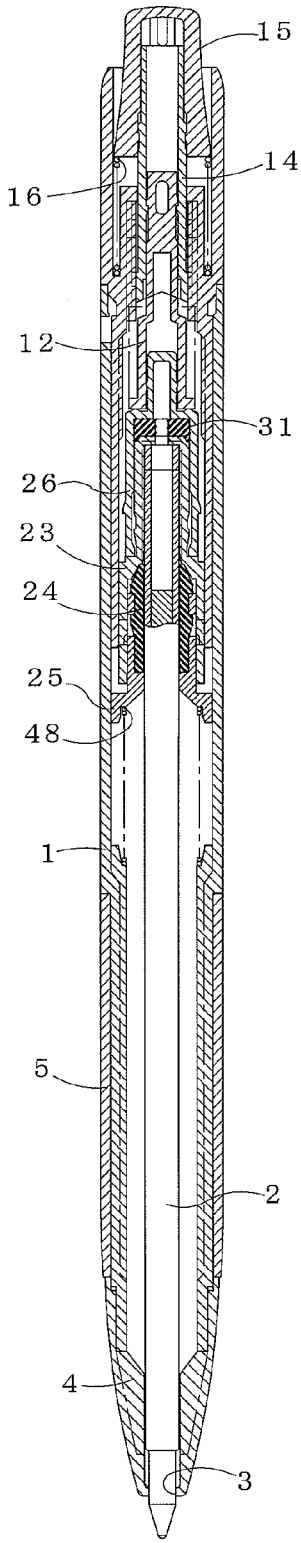
FIG. 14 is a cross-sectional view of the pressurizing-type pen in a state in which the refill is held at the writing position.
Figure 15:
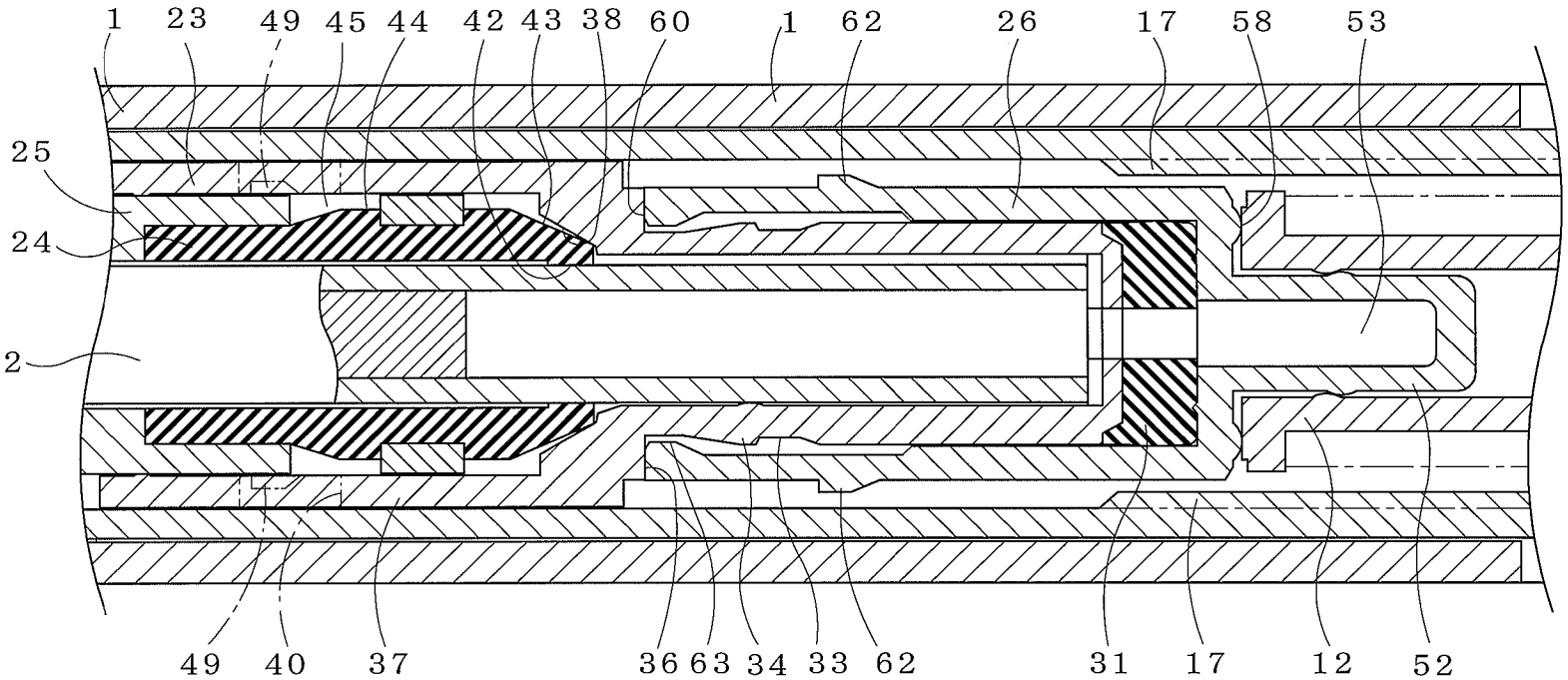
FIG. 15 is an enlarged explanatory view of the pressurizing-type pen in a state in which a rear space of the refill is pressurized.

When the pressing end 60 of the compression cylinder 26 comes into contact with the shoulder part 36 of the refill holder 23 or the elastic member 31 at the rear end of the refill holder 23 abuts on the bottom of the compression chamber 53 (FIG. 15), the refill holder 23, refill 2, airtight member 24 and return spring holder 25 are pressed together by being pressed by the compression cylinder 26 and advance together against the return spring holder 48 (FIG. 13). When the knocking is stopped, the knocking cam 14 and the rotating cam 12 retract and the refill 2 is kept at the writing position as shown in FIG. 14. At this stage, the pressed state is maintained from the state where the compression cylinder is advanced to the state in FIG. 14 and FIG. 15 which illustrate the state where the refill 2 is kept at the writing position, whereby the ink in the refill 2 is continually pressurized. Accordingly, the flowability of the ink is secured during writing and smooth writing can be assured.

Figure 16:
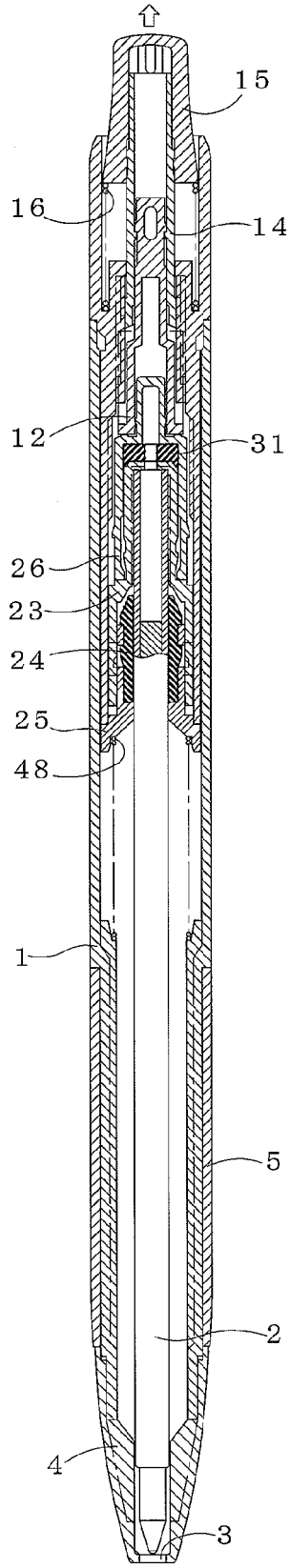
FIG. 16 is an enlarged explanatory view of the pressurizing-type pen in a state in which the knocking part is knocked to retract the refill.

When the knocking part 15 is knocked in the writing state, the rotating cam 12 retracts via the knocking cam 14 as shown in FIG. 16. When the rotating cam 12 starts to retract by the knock spring 16, following this movement, the compression cylinder 26, refill holder 23, refill 2, airtight member 24 and return spring holder 25 retract by the action of the return spring 48. As shown in FIG. 17, the return spring holder 25 and the airtight member 24 stop at the position where the flange 46 of the return spring holder 25 comes in contact with the stopper 47 at the front end of the stationary cam 7. Since the rotating cam 12, compression cylinder 26, refill holder 23 and refill 2 continue to retract by the knock spring 16, the slant face 38 of the refill holder 23 is pulled away from the slant face 43 of the airtight member 24, the pressing of the refill holder 23 on the airtight member 24 is released, and the elasticity of the airtight member causes the inner face 42 of the airtight member 24 to detach from the outer periphery face of the refill 2 (see FIG. 17). As a result, the air vent path 32 running along the outer face of the airtight member 24, the inner face of the refill holder 23, the outer face of the refill 2 and the opening 30 of the refill holder 23 communicates with the outside air, and the pressure in the compression chamber 53 is reduced to ambient pressure. Accordingly, even when the compression cylinder 26 retracts thereafter, the ink in the refill 2 will not be subjected to suction and therefore will not be sucked backwardly out of the refill.

Figure 18:
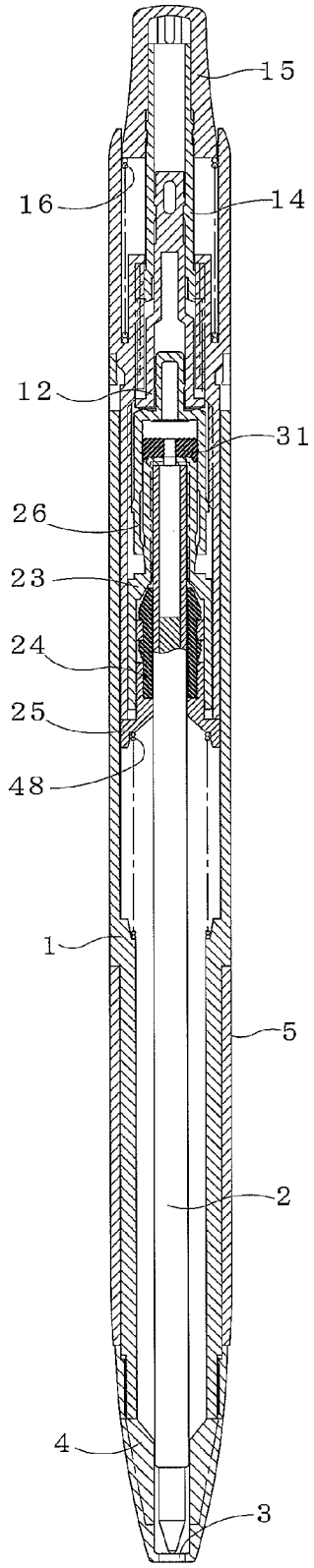
FIG. 18 is a cross-sectional view of the pressurizing-type pen in a state in which the compression cylinder further retracts from the state shown in FIG. 16.
Figure 19:
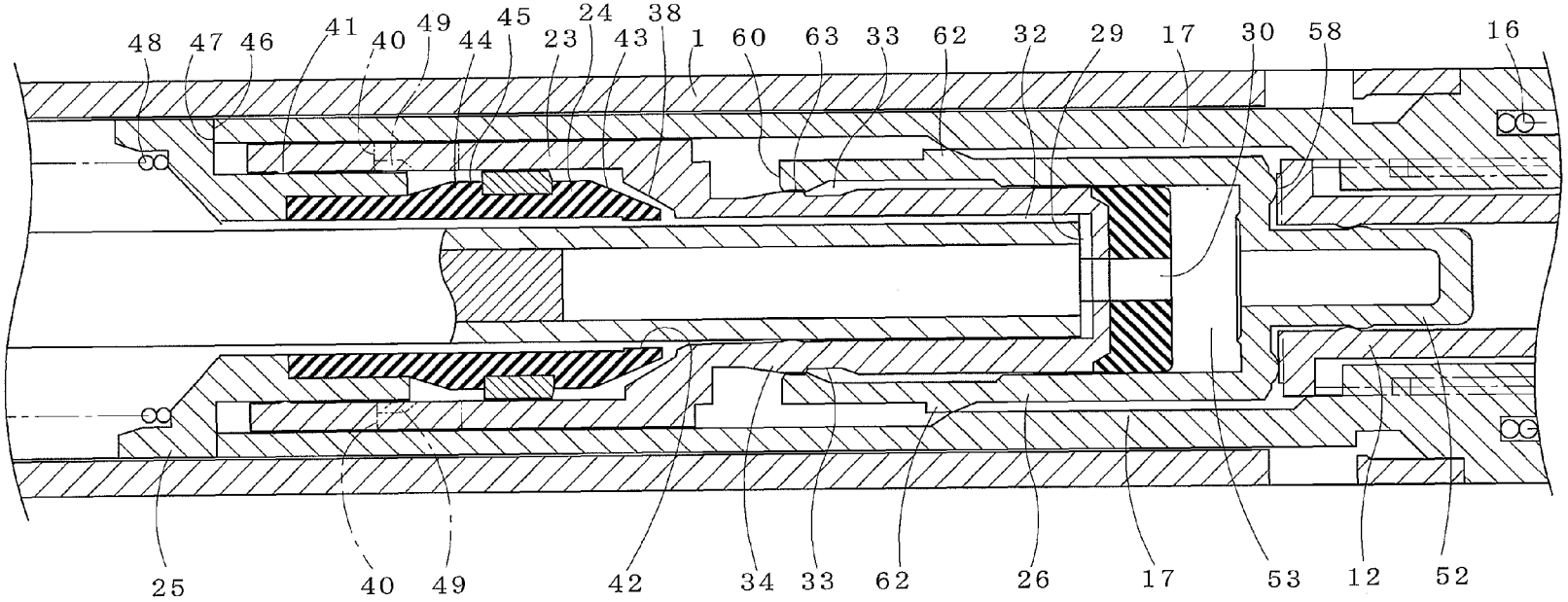
FIG. 19 is an enlarged explanatory view of the pressurizing-type pen showing the state just before the compression cylinder and the refill holder are connected.

After the pressure in the compression chamber 53 is reduced, the compression cylinder 26, refill holder 23 and refill 2 further retract, but when the end edge of the control hole 40 formed at the large diameter part 37 of the refill holder 23 is hooked by the locking click 49 on the return spring holder 25, the retracting movement is stopped, and the refill holder 23 stays at this position (see FIG. 18). However, since the compression cylinder 26 further retracts by being pulled by the rotating cam 12, the locking projections 63 on the compression cylinder move beyond the raised part 34 of the refill holder 23 as shown in FIG. 19. And, when the compression chamber retracts to the position corresponding to the engagement groove 33, the outward projections 62 engage with the inner face of the inward projections 17 of the stationary cam 7, whereby the front end of the compression cylinder 26 is closed, the locking projections 63 engage with the engagement groove 33 and the mechanism returns to the initial state as shown in FIG. 1 and FIG. 8.

In the above example, the inward projections 17 on which the outward projections 62 of the compression cylinder 26 abut are formed on the inner face of the stationary cam 7. However, the inward projections may be directly formed on the inner face of the barrel 1 in such a manner that the outward projections of the compression cylinder 26 abut on the inward projection (not shown). Further, the stopper on which the flange of the return spring holder abuts is formed at the front end of the stationary cam. However, a suitable stopper may be disposed on the inner face of the barrel.

What is claimed is:

1. A pen comprising: barrel; an ink-containing refill disposed in the barrel to undergo movement in an axial direction between a writing position and a retracted position; and a pressurizing mechanism to pressurize a rear space of the refill when the refill is moved to the writing position, the pressurizing mechanism comprising a refill holder that holds a rear portion of the refill and that has an opening at its rear end, an elastic airtight member surrounding a periphery of the refill while providing a vent path between the airtight member and the refill, a return spring holder which holds the airtight member and which is connected to a front portion of the refill holder to undergo movement in the axial direction within a predetermined range, a return spring that urges the return spring holder axially backwardly to a position abutting on a stopper disposed in the barrel, a compression cylinder fitted to a rear portion of the refill holder and having a compression chamber at its inside, and a knocking-type feeding mechanism disposed in the barrel to move the compression cylinder back and forth in the axial direction; wherein an inner face of the refill holder faces the airtight member so that when the refill holder advances, the inner face of the refill holder presses and elastically deforms the airtight member to bring an inner face of the airtight member into close contact with an outer periphery face of the refill to close the vent path, the compression cylinder and the refill holder are connected by releasable connecting means for connecting the compression cylinder and the refill holder so that when the compression cylinder advances, the compression cylinder and the refill holder can advance together to a position where the refill holder presses and deforms the airtight member and then releasing the connection of the compression cylinder and the refill holder so that the compression cylinder can move closer to the refill holder, and the refill holder with the refill and the return spring holder with the airtight member are moved forward by the compression cylinder against the return spring.

2. A pen according to claim 1; wherein a slant face is formed on each of the inner face of the refill holder and an end face of the airtight member facing the inner face of the refill holder.

3. A pen according to claim 2; wherein a pressing end portion which abuts on a shoulder part of the refill holder is formed at a front end of the compression cylinder.

4. A pen according to claim 1; wherein the releasable connecting means comprises a locking projection formed on a front end face of the compression cylinder and an outward projection disposed on an outer periphery face of the compression cylinder, an inward projection which is provided in the barrel and on which the outward projection abuts when the compression cylinder is located at the retracted position, and an engagement groove which is formed on an outer periphery face of the refill holder and with which the locking projection of the compression cylinder engages; and wherein the front end of the compression cylinder is elastically expandable and contractable in the radial direction so that when the outward projection engages with the inward projection of the barrel, the front end of the compression cylinder radially contracts and the locking projection of the compression cylinder engages with the engagement groove of the refill holder, and when the outward projection is detached from the inward projection of the barrel, the front end radially expands and the engagement between the locking projection of the compression cylinder and the engagement groove of the refill holder is released.

5. A pen according to claim 1; wherein an elastic member is disposed integrally at a rear end of the refill holder.

6. A pen according to claim 5; wherein an annular projection on which the elastic member abuts is disposed in the compression cylinder.

7. A pen according to claim 1; wherein the knocking-type feeding mechanism is a rotating cam type feeding mechanism comprising a stationary cam, a knocking cam and a rotating cam, and the knocking cam and the rotating cam are connected so that when the refill is retracted to the retracted position, the rotating cam can retract together with the knocking cam.

8. A pen according to claim 7; wherein the compression cylinder is connected to the rotating cam to move axially but not rotationally with the rotating cam.

9. A pen according to claim 1; wherein a pressing end portion which abuts on a shoulder part of the refill holder is formed at a front end of the compression cylinder.

10. A pen comprising: a barrel; an ink-containing refill disposed in the barrel; a refill holder that holds a rear portion of the refill and that is disposed in the barrel to undergo movement in an axial direction between a writing position in which a front end of the refill protrudes from the barrel and a retracted position in which the front end of the refill is retracted into the barrel; a vent path that communicates a space inside the rear portion of the refill to outside the pen; an elastic member surrounding a periphery of the refill such that a space between the elastic member and the refill comprises a section of the vent path; and a compression cylinder slidably fitted onto a rear portion of the refill holder and releasably connected thereto to move the refill holder from the retracted position to the writing position during forward movement of the compression cylinder, wherein during an initial stage of forward movement of the compression cylinder, the refill holder is moved into pressing contact with the elastic member and elastically deforms the elastic member into clamping engagement with the refill thereby closing the vent path, and thereafter during continued forward movement of the compression cylinder, the compression cylinder disconnects from the refill holder and moves relative thereto to pressurize the space inside the rear portion of the refill thereby pressurizing the ink contained in the refill.

11. A pen according to claim 10; wherein the refill holder has an inclined face that presses against an inclined face of the elastic member to clamp the elastic member to the ink refill.

12. A pen according to claim 10; wherein the compression cylinder has a front part that is elastically expandable in the radial direction, the front part being slidably engageable with a fixed part of the pen during the initial stage of forward movement of the compression cylinder to elastically contract the front part into releasable engagement with the refill holder and disengageable from the fixed part during continued forward movement of the compression cylinder to elastically expand the front part out of engagement with the refill holder.

13. A pen according to claim 12; further including a knocking mechanism disposed in the barrel to move the compression cylinder forward and backward in the axial direction.

14. A pen according to claim 13; wherein the knocking mechanism is a rotating cam feeding mechanism comprising a stationary cam, a knocking cam and a rotating cam, and the knocking cam and the rotating cam are connected so that when the refill holder is retracted to the retracted position, the rotating cam retracts together with the knocking cam.

15. A pen according to claim 14; wherein the compression cylinder is connected to the rotating cam to move axially but not rotationally with the rotating cam.

16. A pen according to claim 10; further including a knocking mechanism disposed in the barrel to move the compression cylinder forward and backward in the axial direction.

17. A pen according to claim 16; wherein the knocking mechanism is a rotating cam feeding mechanism comprising a stationary cam, a knocking cam and a rotating cam, and the knocking cam and the rotating cam are connected so that when the refill holder is retracted to the retracted position, the rotating cam retracts together with the knocking cam.

* * * * *